US009522340B1

(12) United States Patent
Binkley et al.

(10) Patent No.: US 9,522,340 B1
(45) Date of Patent: Dec. 20, 2016

(54) COMPRESSED AIR POWER SYSTEMS THAT USE STORED ENERGY TO PROPEL TOY ITEMS

(71) Applicants: Dennis E. Binkley, Seattle, WA (US); Jesse Oliver Binkley, Seattle, WA (US)

(72) Inventors: Dennis E. Binkley, Seattle, WA (US); Jesse Oliver Binkley, Seattle, WA (US)

(73) Assignee: Geospace Holding Co. Inc., Seattle, WA (US)

( * ) Notice: Subject to any disclaimer, the term of this patent is extended or adjusted under 35 U.S.C. 154(b) by 0 days.

(21) Appl. No.: 14/792,266

(22) Filed: Jul. 6, 2015

(51) Int. Cl.

| | |
|---|---|
| ***A63H 29/16*** | (2006.01) |
| ***A63H 27/00*** | (2006.01) |
| ***A63H 27/14*** | (2006.01) |
| *F41B 5/00* | (2006.01) |

(52) U.S. Cl.
CPC ..... *A63H 29/16* (2013.01); *A63H 27/005* (2013.01); *A63H 27/14* (2013.01)

(58) Field of Classification Search
CPC ..... A63H 27/00; A63H 27/26; A63H 29/00; A63H 33/00; F41B 5/126; F41B 7/006; F41B 7/003; F41B 5/00; F41B 5/14; F41A 21/10
USPC ..... 446/180, 186, 197, 211, 212, 429, 430,446/473; 124/56, 60, 63–67, 25.7, 25.5, 82, 86
See application file for complete search history.

(56) References Cited

U.S. PATENT DOCUMENTS

| | | | | |
|---|---|---|---|---|
| 5,242,323 A * | 9/1993 | Rappaport | F41B 11/642 | 124/63 |
| 5,791,326 A * | 8/1998 | Brown | F41B 11/642 | 124/66 |
| 8,485,171 B2 * | 7/2013 | Romney | F41A 21/10 | 124/65 |
| 8,991,374 B1 * | 3/2015 | Conkel | F41B 5/126 | 124/23.1 |

* cited by examiner

*Primary Examiner* — Kien Nguyen
(74) *Attorney, Agent, or Firm* — Clark A. Puntigam; Jensen & Puntigam, P.S.

(57) ABSTRACT

The toy rocket includes inner and outer sleeve members with the inner sleeve member fitting into the outer sleeve in a slidable airtight relationship. An end assembly extends from a distal end of the inner sleeve member, including a launch tube at the distal end thereof. An external elongated member is supported by the end assembly and has holding elements at opposing ends thereof. A stretchable cord member extends from one holding member to an end piece of the outer sleeve member then to the other holding member, wherein rearward movement and then release of the outer sleeve member pushes air through the launch tube launching the toy rocket into the air.

12 Claims, 14 Drawing Sheets

COMPRESSED AIR POWER SYSTEMS THAT USE STORED ENERGY TO PROPEL TOY ITEMS

TECHNICAL FIELD

This invention is directed towards improving the performance of toy products that use compressed air to project or launch items such as rockets, planes or other objects.

BACKGROUND OF THE INVENTION

It is well known that flying toys such as rockets and planes can be launched using compressed air. It is also well known that the compressed air can be generated by a number of different methods including but not limited to a moveable piston; two sliding members that are used to create a reduced volume of air while increasing the air pressure; a bellows or squeeze bottle; and a cylinder of compressed air.

It is typical that the toy to be launched is attached to the compressed air generating means by either inserting into or sliding over a projection or launch tube from the air escape route. Most of these products require the user to compress the air at the time it is desired to project or launch the item. This is typically achieved by the action of squeezing or sliding components quickly. The resulting performance and the ability to make the projected or launched item go where desired is limited to the strength and abilities of the operator.

Most users of these products are children, many of whom will not have the dexterity or strength to operate the mechanism to its maximum capability. The present invention allows the user to first load energy into a secondary mechanism that retains the energy until it is desired to project or launch the toy item. As energy is inputted by pulling on one component of the mechanism at any speed, less dexterity and strength is required to fully implement or charge the mechanism. Once released, the stored energy is used to rapidly compress the air used to launch the toy item.

SUMMARY OF THE INVENTION

Accordingly, the toy rocket launch system comprises: an outer sleeve member; an inner sleeve member which fits in a slidable airtight relationship with the outer sleeve member; an end assembly which extends from a distal end of the inner sleeve member; a rigid bow member having an opening through which the end assembly extends, the bow member having holding elements at opposing ends thereof; a stretchable cord member which extends from one holding element to an end piece of the outer sleeve member and then to the other holding member, such that as the outer sleeve member is drawn rearwardly away from the inner sleeve, an internal pump chamber increases in volume between the proximal end of the inner sleeve member and the internal end of the outer sleeve member; and a launch tube at the distal end of the end assembly for support of a toy foam rocket, wherein when the rearwardly extended tensioned outer sleeve member is released a large volume of air moves through the inner sleeve member and through the launch tube, launching the toy rocket into the air.

BEST MODE FOR CARRYING OUT THE INVENTION

This invention provides a means of storing energy in a device/mechanism where that energy can be released when desired to operate various air compression means used to propel or launch toy rockets, planes, etc.

The mechanisms that can be used to store energy include but are not be limited to: springs of all kinds, including but not limited to: coil, neg'ator, compression and leaf, and elastics of kinds, including but not limited to: bungee, silicon, surgical rubber.

Energy can be stored in the mechanisms in many different ways, including but not limited to, physical force input from the operator, water pressure and pressurized gas.

The secondary initial energy source can be built into the means of generating the compressed air or be external to it.

Figure 1A:
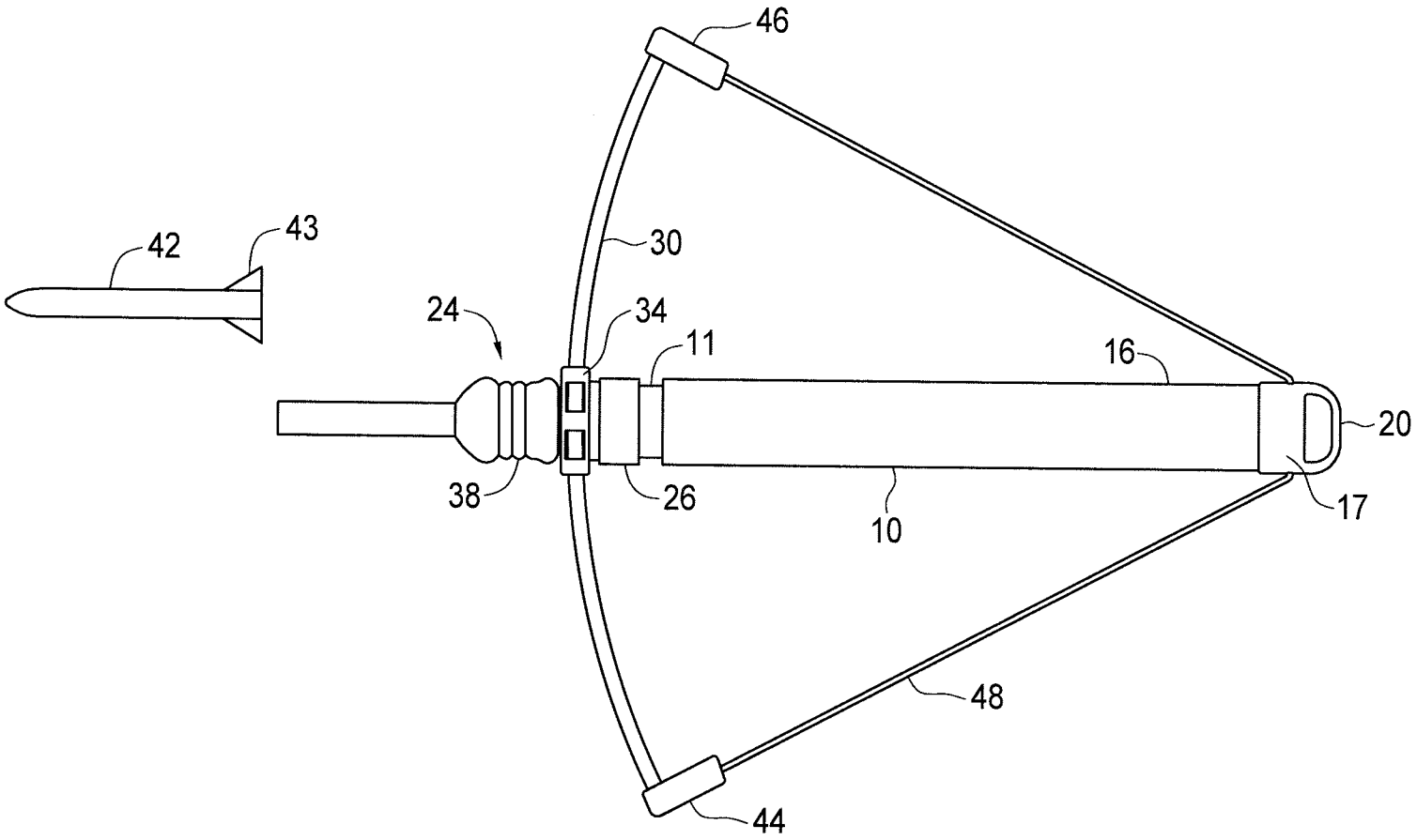
FIG. 1A is an elevational view of one embodiment of the present invention in an initial rest position.
Figure 1B:
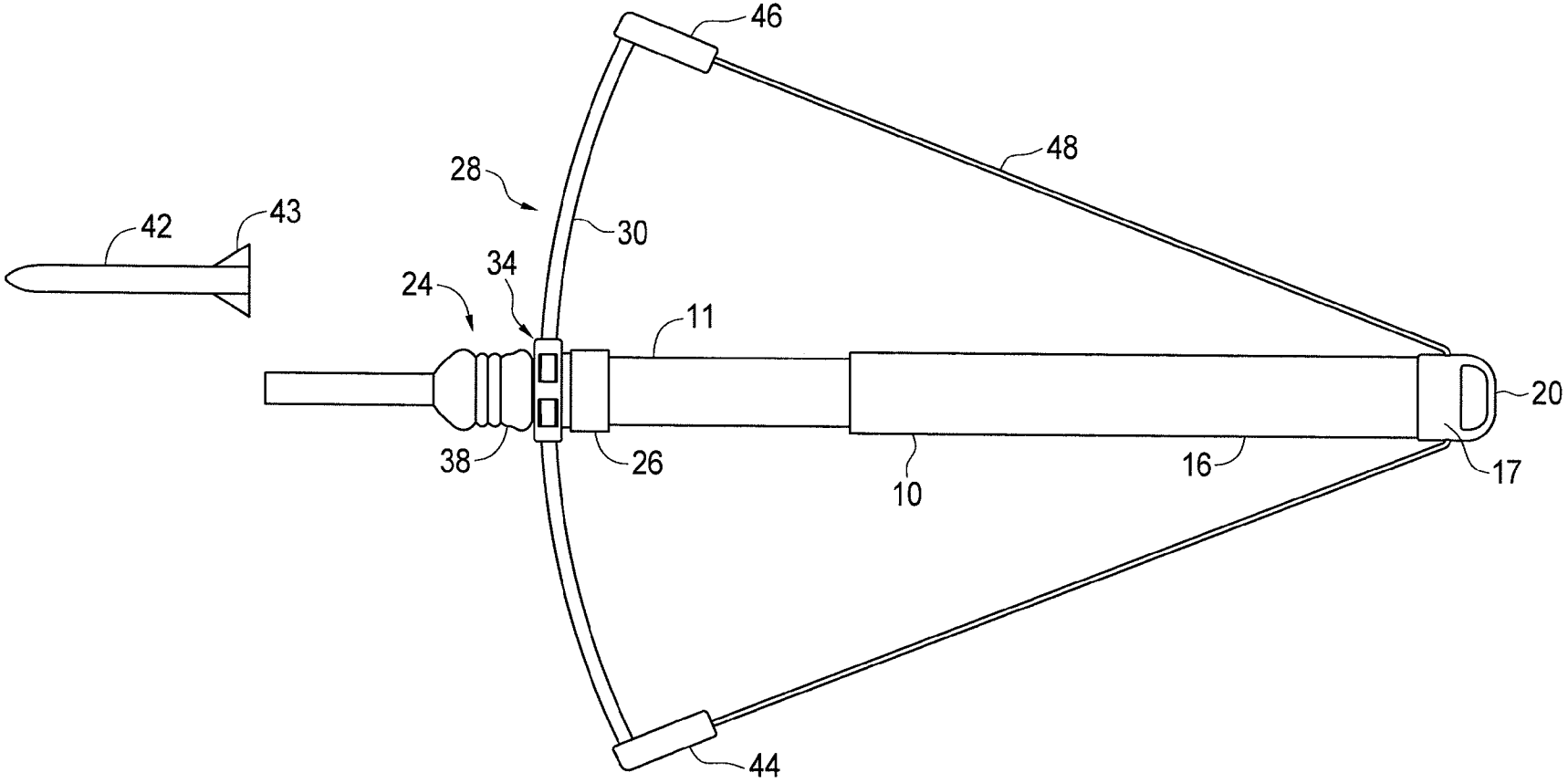
FIG. 1B is an elevational view of the embodiment of FIG. 1A in an extended position.

There are two preferred embodiments, each of which include attaching either bungee, rubber or coil springs internally or externally to the sliding chambers used to rapidly compress the propulsion air. Pulling the sliding chambers apart to fill them with air also puts the springs or bungees under tension; in effect, storing energy in the springs/bungee. Referring to FIGS. 1A and 1B, for example, when the outer pump sleeve 10 is drawn back, the bungee bow cords 12 in FIGS. 1A and 1B are "loaded" or tensioned with increasingly more powerful latent force/energy the more the outer pump sleeve is slowly pulled back; and at the same time, air is slowly drawn into the extended internal pump air chamber 16, also shown in FIG. 2B, thereby increasing and maximizing the total volume of air inside the extended pump air chamber for rapid compression upon release. Upon release of the outer pump sleeve and rapid return to its normal unloaded, relaxed state, there is a "violent" rapid compression of air that is directed up and out of the forward end of the narrower diameter launch tube 18 that has a foam rocket or other toy mounted thereon, which powers the foam rocket with the forced air energy created by the tension of the bungee bow cord.

The key functionality achieved by this invention that is not possible otherwise is the amount of air pressure released and directed out of the launch tube in order to propel the foam rocket or other toy much greater distances with greater accuracy than would otherwise be possible. The launcher is aimed in the direction desired and then the energized chamber is released, rapidly compressing the air and thereby launching items such as toy rockets, planes and other objects.

The power imputed is controlled by the operator and depends on how far the chambers are moved apart.

In another configuration, the energized sliding chambers are held in place with a separate mechanism. When it is desired to launch the rocket, plane or other item, this mechanism is operated by the user to release the stored energy.

Figure 1C:
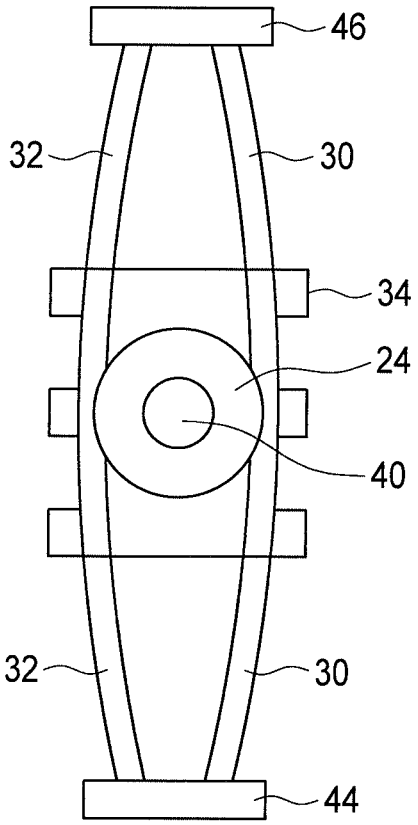
FIG. 1C is an end view of the embodiment of FIG. 1A.

More specifically, with respect to FIGS. 1A and 1B, the pump mechanism as indicated above includes an outer pump sleeve 10 and an inner pump sleeve 11. The inner pump sleeve 11 fits internally into outer pump sleeve in an airtight, slidable relationship. In the rest position (FIG. 1A), the proximal end of the inner pump sleeve is located approximately ¾th of the length of the outer pump sleeve. In the embodiment shown, the outer pump sleeve has a diameter of 1⅝ inches, while the inner sleeve has a diameter of 1⅜ inches. Both the inner and outer pump sleeves are made of a hard plastic. The outer pump sleeve has an end piece 17 at its proximal end. Extending from the rear end of end piece 17 is a loop 20 which is large enough for a user to insert their finger(s) therethrough, if desired. At the distal end of the inner pump sleeve is an extending end assembly 24. End assembly 24 includes a first portion 26 which is attached to the distal end of the inner pump sleeve. The end assembly then narrows, extending through an opening in a bow member 28. Bow member 28 in the embodiment shown comprises two spaced rods 30, 32 of hard plastic separated by a small distance, approximately ¾ inch next to the end assembly, as shown in FIG. 1C. The rods extend through a central placement member 34 having a central opening therethrough. The placement member maintains the spacing between the two rods at the end assembly. In the embodiment shown, the bow member is approximately 12 inches long and is curved, although it can be shorter, close to the placement member, within 1-2 inches. The end assembly 24 includes a neck portion which extends through an opening in the placement member 34. On the distal side of the neck portion is a hand gripping portion 38 having a proximal end with a diameter of approximately 1½ inches, so that the central placement member of the bow portion is held firmly in place by the neck portion, between the end piece and the proximal end of the gripping portion 38. Gripping portion 38 is approximately 3 inches long.

Extending from the distal end of the gripping portion 38 is a launch tube 40. In the embodiment shown, the launch tube is approximately 7 inches long and has a diameter of approximately ⅝ inch, although these dimensions can be changed. Positioned on the launch tube is a soft foam rocket element 42 which can have various configurations, but typically includes a pointed distal end with four fins 43 spaced equally around the lower end thereof.

Attached to the ends of the two rods 30 are holding elements 44 and 46. Extending from one holding element through the end piece 17 and then to the other holding element 46 is a resilient bungee cord 48 or other stretchable material. In the embodiment shown, bungee cord 48 is approximately ⅛-inch thick and ¾-inch wide.

In use, the outer pump sleeve is pulled back, creating a significant tension on the stretchable element, with the air chamber 16 increasing in length between the proximal end of the inner pump sleeve and the internal end of outer pump sleeve. Typically, there will be 8 inches or so of space between the two when the outer pump sleeve is pulled all the way back, although effective action can still be achieved without the outer sleeve at its extreme position. The inner pump sleeve includes a small lip at the proximal end which prevents the outer sleeve from being pulled all the way off the inner pump sleeve. When the outer pump sleeve is released, a blast of compressed air expands through the extended inner pump sleeve, the end assembly and the launch tube forcing the rocket off the launch tube for an extended height and/or distance; in the embodiment shown, the force will be between 5-12 pounds.

Figure 2A:
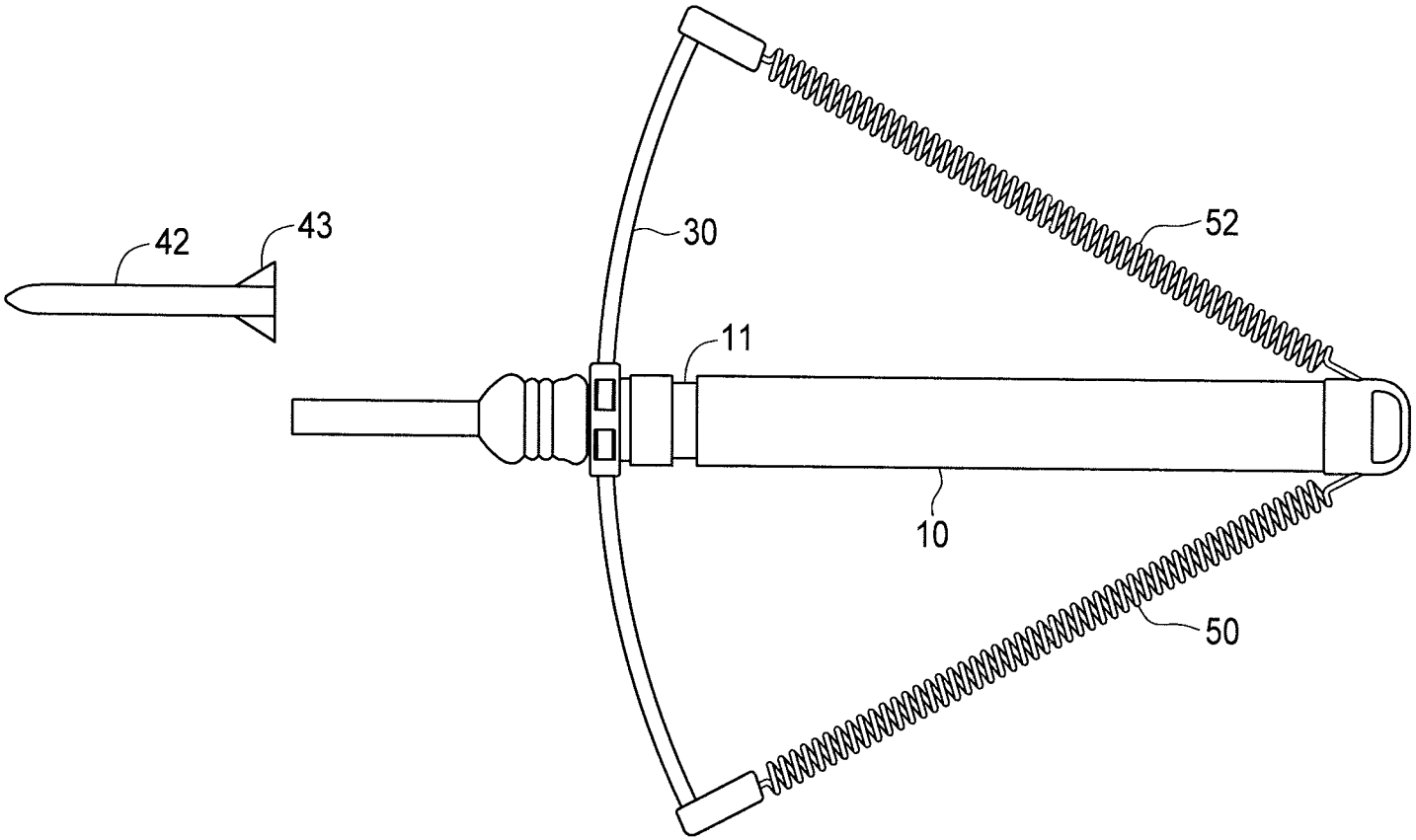
FIG. 2A is an elevational view of another embodiment in an initial rest position.
Figure 2B:
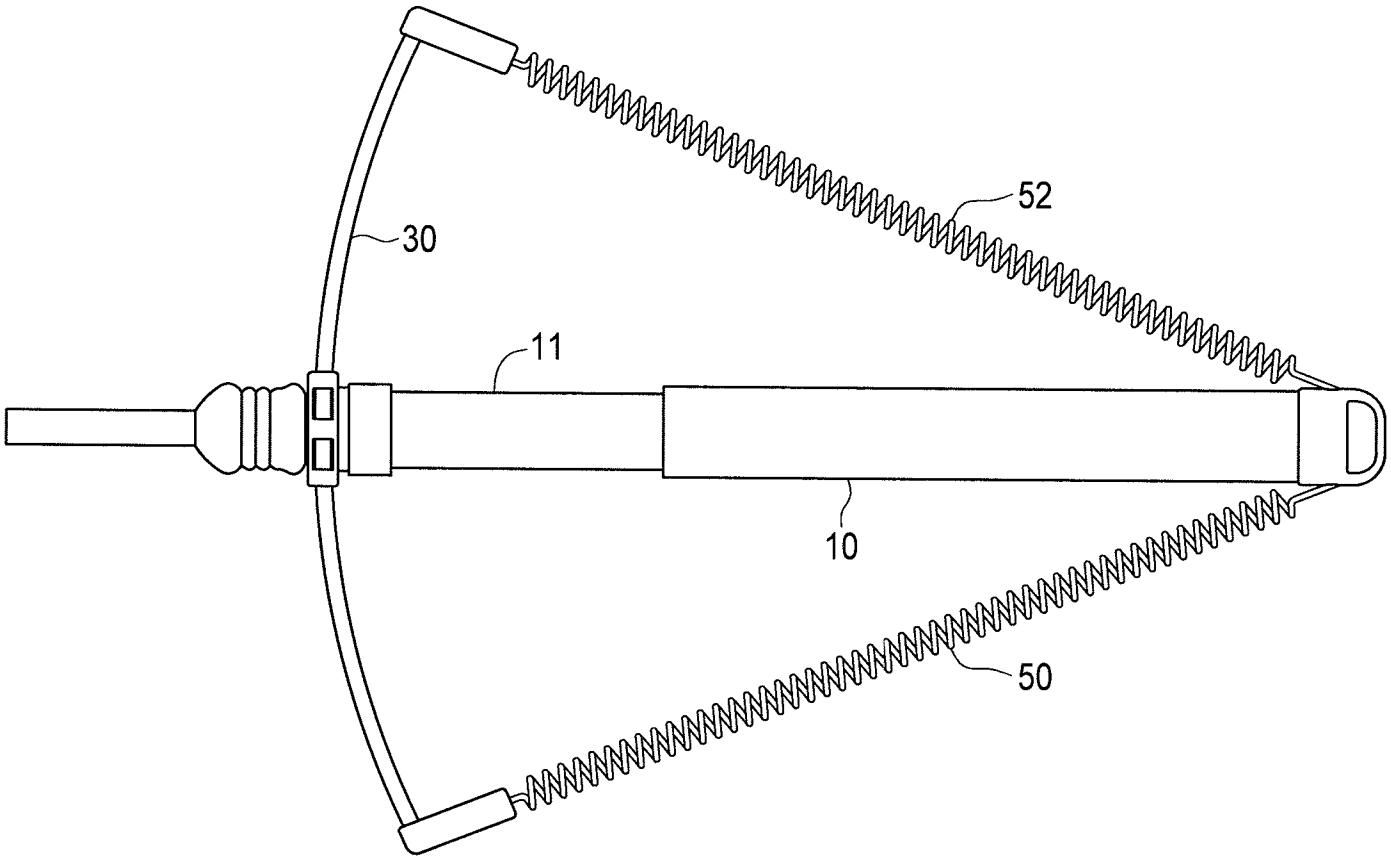
FIG. 2B is an elevational view of the embodiment of FIG. 2A in an extended position.

FIGS. 2A and 2B show a similar arrangement to FIGS. 1A and 1B, except that the bungee cords are replaced by springs 50 and 52. In the embodiment shown, the springs 50 and 52, respectively, will extend between holders 44 and 46 and the end piece 17.

The operation of the embodiments of FIGS. 1A, 1B and 2A, 2B are identical in producing a strong force of air through the launch tube, forcing the rocket 42 off the launch tube in a long, graceful arc. The speed and distance of travel of the rocket will depend upon the volume and force of air through the launch tube. The speed and distance, however, is substantially greater than a hand-operated pump arrangement, such as shown in U.S. Pat. No. 6,568,985, owned by the assignee of the present invention.

Figure 3A:
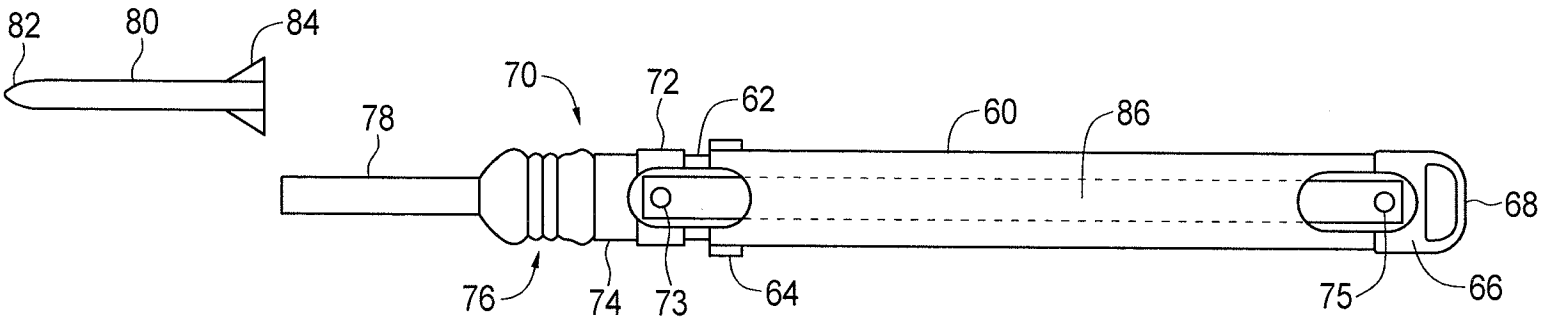
FIG. 3A is a partially cutaway view of another embodiment in an initial rest position.
Figure 3B:
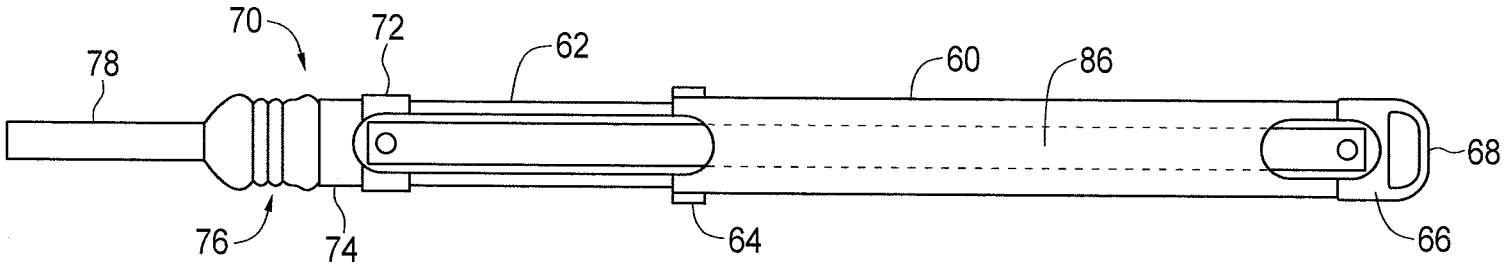
FIG. 3B is a partially cutaway view of the embodiment of FIG. 3A in an extended position.

Referring now specifically to FIGS. 3A and 3B, for another embodiment, the pump mechanism includes an outer pump sleeve 60 and an inner pump sleeve 62 which fits inside the outer pump sleeve 60 in a slidable, airtight relationship. In the embodiment shown, the outer pump sleeve and the inner pump sleeve are both made of hard plastic. The outer pump sleeve is approximately 8 inches long and 1½ inches in diameter and includes a distal end piece 64 through which the inner pump sleeve extends into the outer pump sleeve, and a proximal end piece 66 which includes a finger loop 68 which extends therefrom. At the distal end of inner pump sleeve 62 is an extending end assembly 70. The extending end assembly 70 includes an end piece 72 which fits over and is attached to the distal end of the inner pump sleeve. From end piece 72, the extending end assembly includes a neck portion 74 and then a handgrip portion 76 which includes ridges and end portions to fit the hand of a user, particularly the hand of a child. Extending from the handgrip portion 76 is a launch tube 78. In the embodiment shown, the launch tube is approximately 3½ inches long and has a diameter of approximately ½ inch. Fitted onto the launch tube is a foam rocket 80, having a pointed front piece 82 and fins 84 equally spaced at the rear end thereof. Internally is a bungee cord 86, which extends from a hook internally at end piece 73 of end assembly 70 to a hook member 75 internally at end piece 66 of the outer pump sleeve. In use, the outer pump sleeve is pulled back, increasing the tension on the bungee cord. In one embodiment, the outer sleeve member can be pulled back approximately 8 inches. When the outer pump sleeve is released, a great rush of air moves upwardly through the extending end assembly and into the launch tube, forcing the pump rocket off launch tube a long distance. The advantage of the arrangement of FIG. 3A is that a child or other person without significant strength can still produce significant rocket action and launch the rocket for a high and/or long distance, which is satisfying to the user, particularly a child.

The stretchable member 36 can either be a bungee-type material or other elastic resilient material.

Figure 4A:
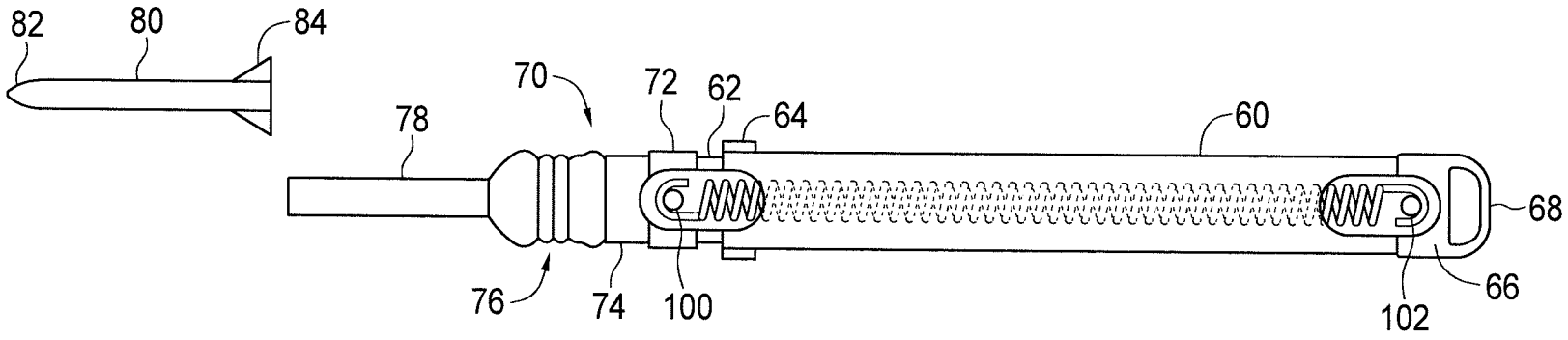
FIG. 4A is a partially cutaway view of another embodiment in an initial rest position.
Figure 4B:
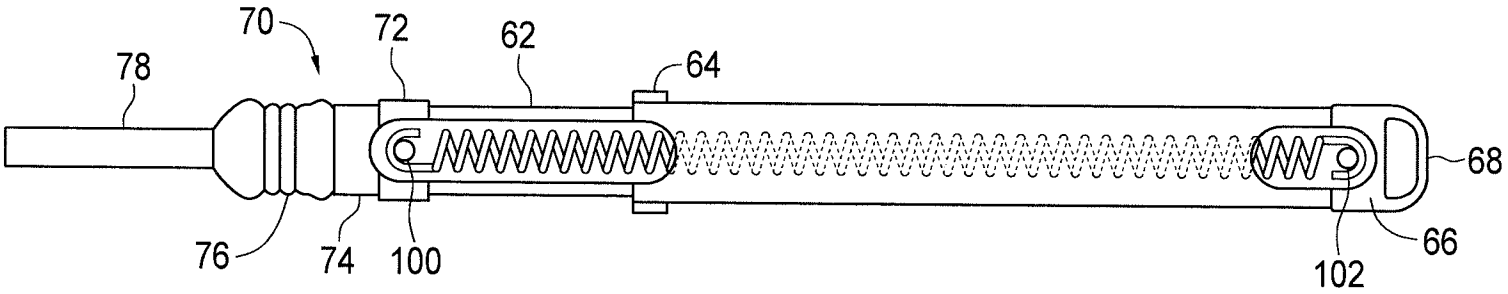
FIG. 4B is a partially cutaway view of the embodiment of FIG. 4A in an extended position.

An alternative to the embodiments of FIGS. 3A and 3B is shown is FIGS. 4A and 4B, in which the stretchable member is in the form of a metal spring 94, connected to interior hooks 100, 102.

Figure 5:
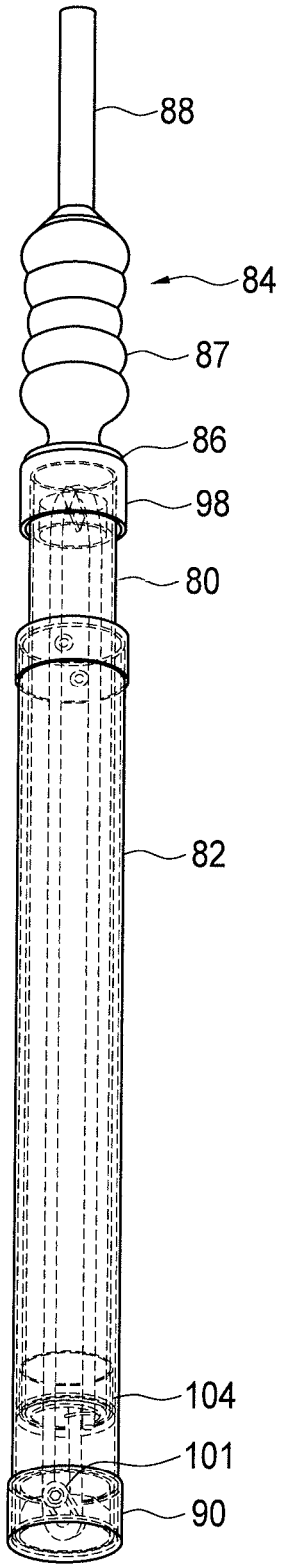
FIG. 5 is a see-through perspective view of yet another embodiment of the present invention.
Figure 7A:
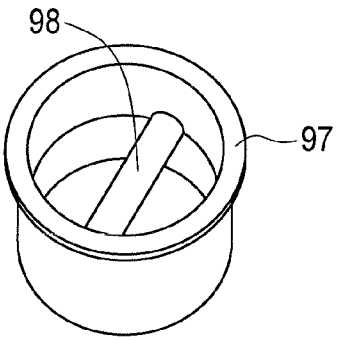
FIG. 7A is a perspective view of a portion of the embodiment of FIG. 5.
Figure 7B:
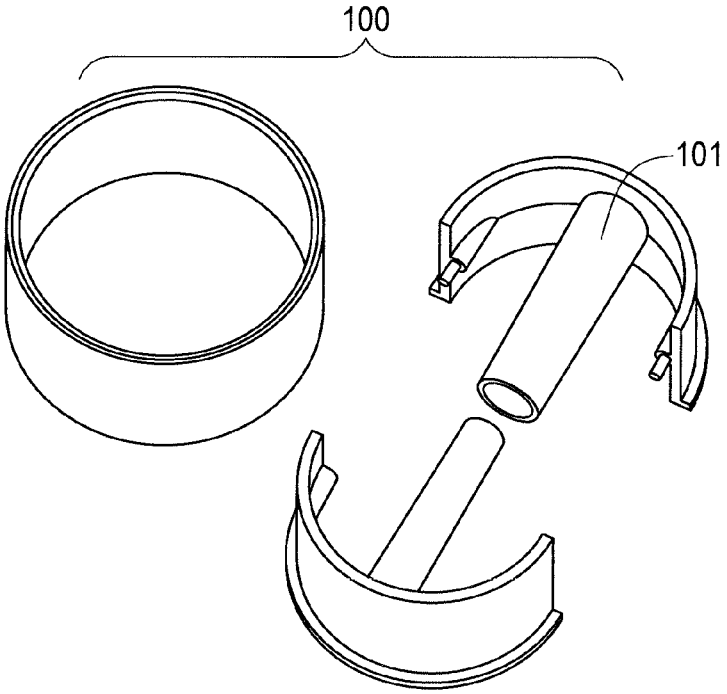
FIG. 7B is a perspective view of another portion of the embodiment of FIG. 5.

FIG. 5 is a further embodiment of the present invention, generally similar to the embodiments of FIGS. 3A and 3B, using a bungee cord. FIG. 5 includes a hollow inner pump sleeve 80 and a hollow outer pump sleeve 82, wherein the inner pump sleeve fits inside the outer pump sleeve and in a slidable, airtight relationship. At the distal end of inner pump sleeve is an extending end assembly 84 which includes an end piece 86 which fits over and is attached to the distal end of the inner pump sleeve, along with a handgrip portion 87 and launch tube 88. At the proximal end of the outer pump sleeve 82 is an end cap 90. Positioned at the distal end of the inner sleeve 80, is a forward bungee cord retaining collar 97 with a crosswise post 98, shown in FIG. 7A, while at the proximal end of the outer sleeve 82 is a rear bungee cord retainer assembly 100, with a crosswise post 101, shown in FIG. 7B. A bungee cord 102 fits around the two spaced retaining posts. The ends of the bungee cord are crimped together at 104 to provide a single cord loop.

Figure 6:
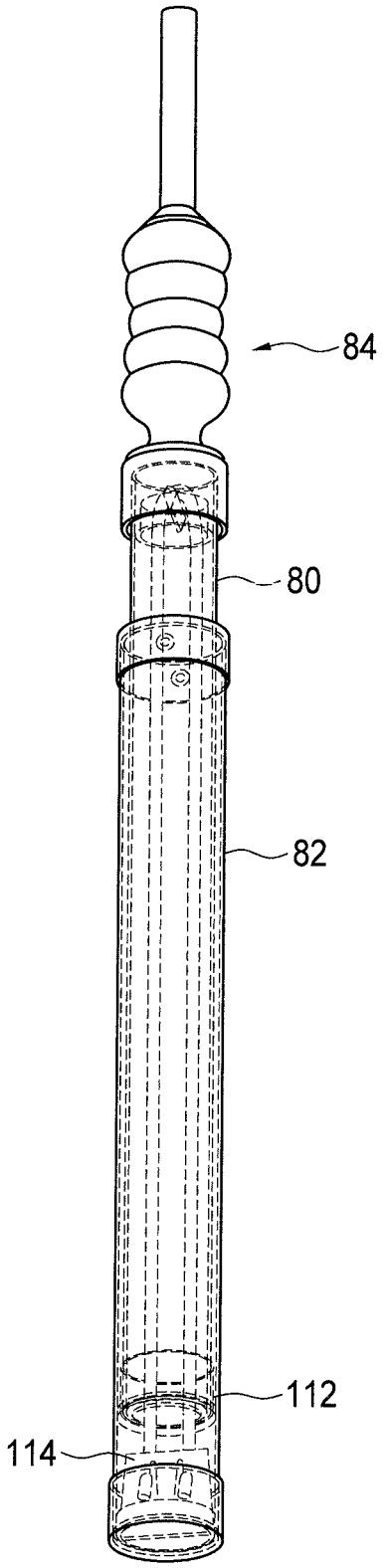
FIG. 6 is a see-through perspective view of still another embodiment of the present invention.
Figure 8:
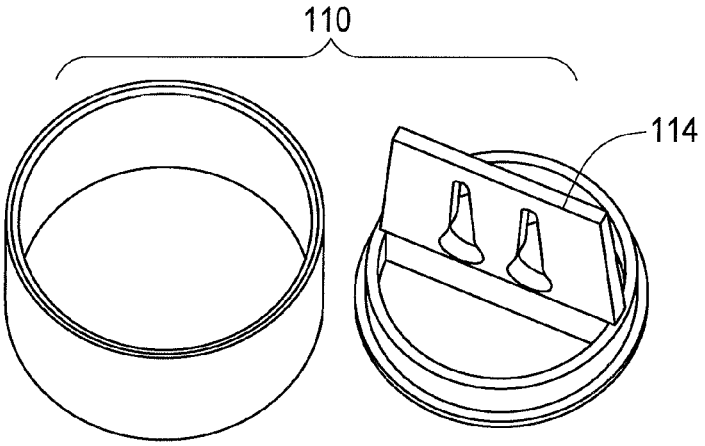
FIG. 8 is a perspective view of a portion of the embodiment of FIG. 6.
Figure 9:
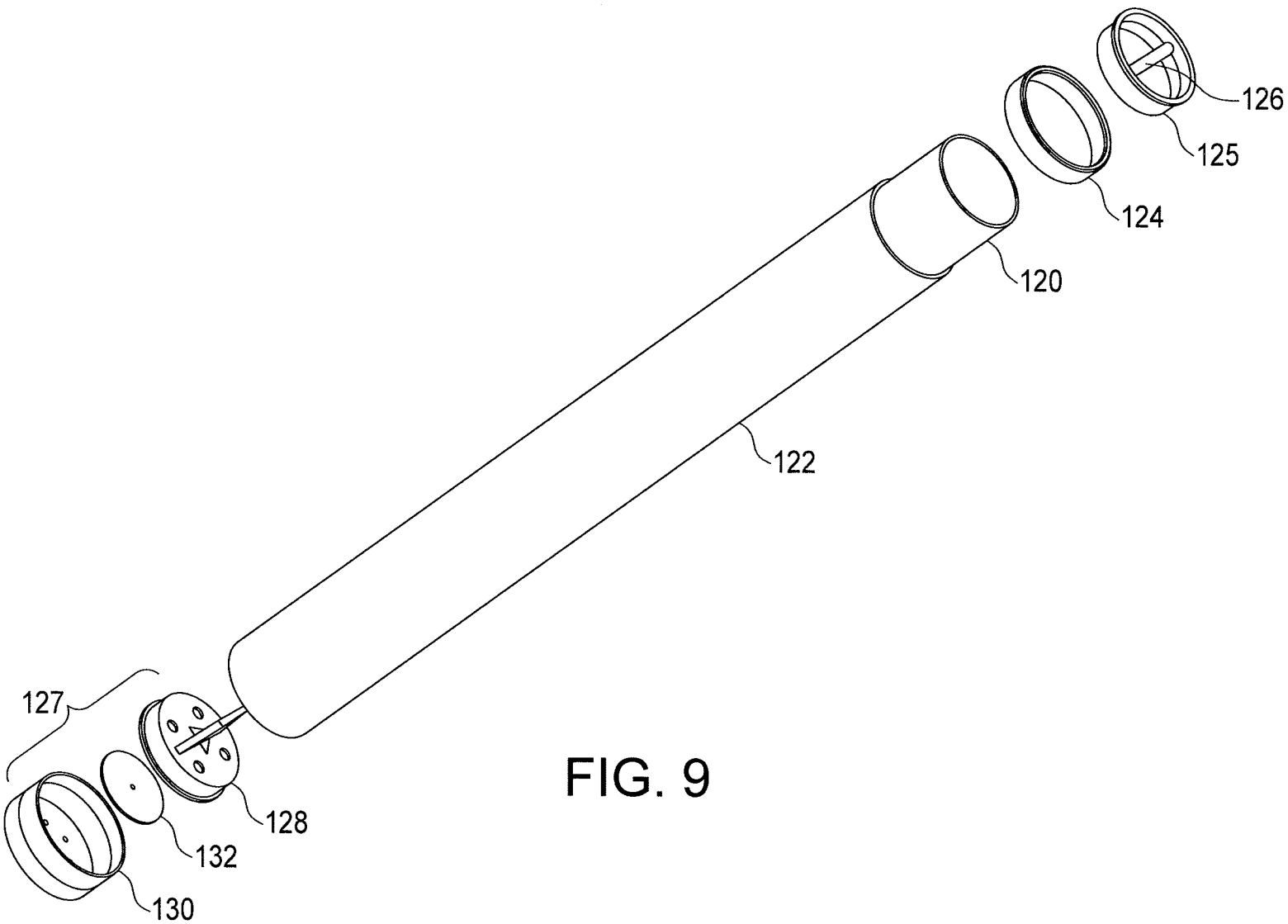
FIG. 9 is a perspective view of a variation of the embodiment of FIG. 5.
Figure 10:
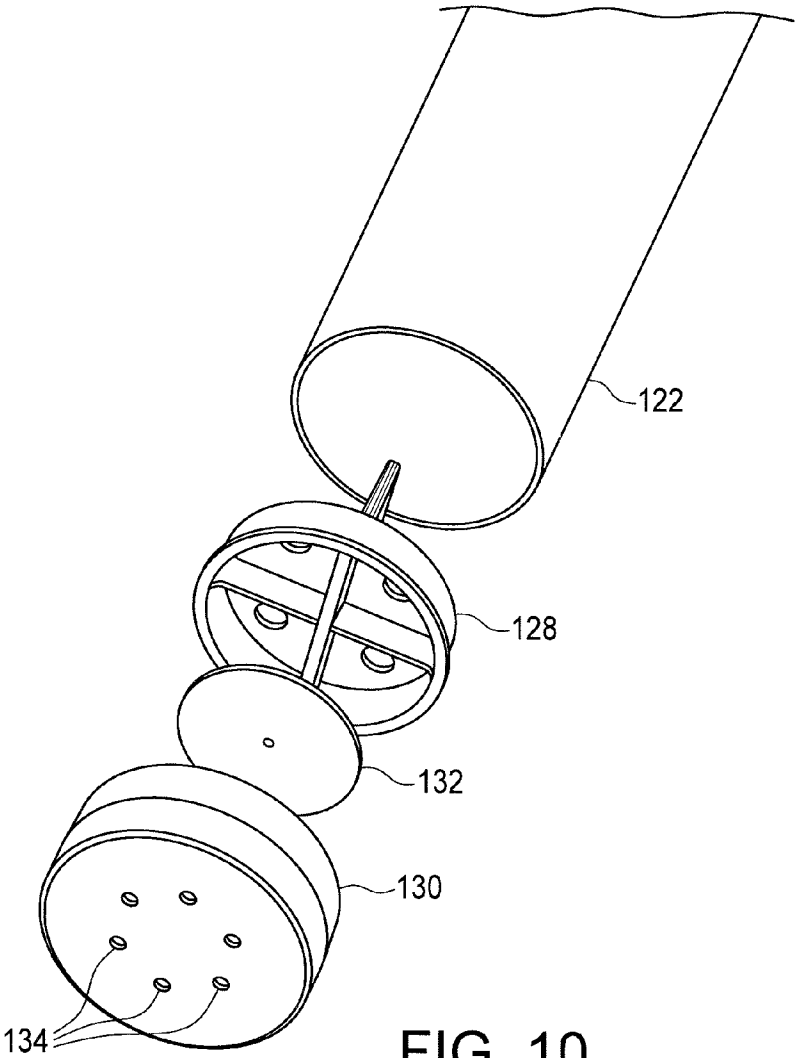
FIG. 10 is a perspective view of a portion of the embodiment of FIG. 9.

FIGS. 6 and 8 show an alternate structure for the rear bungee retaining collar assembly 110. In this arrangement, the two ends of a single bungee cord 112 are pinch gripped in a retainer unit 114.XXX FIGS. 9 and 10 show a variation of the embodiment of FIG. 5. It includes an inner pump sleeve 120 and an outer pump sleeve 122. At the distal end of inner pump sleeve 120 is a collar 124 and an end piece 125 with a crosswise post 126 around which the bungee cord extends. At the proximal end of outer pump sleeve 122 is a rear bungee cord retaining assembly 127, including a bungee cord attachment member 128 and an end cap 130. Between the bungee attachment member 128 and end piece 130 is a foam disc 132. The foam disc 132 in the embodiment shown is approximately 1-1.25 mm thick and fits in the space between the end piece 130 and attachment member 128. The end cap in the embodiment shown has a plurality of small openings 134 arranged in a circular pattern, while the retainer 128 has four spaced openings 136 slightly larger in diameter than openings 134. The foam disc 132 acts as a flap valve for the pump assembly.

Again, in operation for both of these embodiments, the outer pump sleeve is pulled back to increase tension on the bungee cord. When the outer sleeve member is then released, a large volume of air moves through the inner sleeve member and out through the end assembly, launching the rocket. Hence, with this arrangement, the user only has to pull back the outer pump sleeve and then release it, in essence one active step to launch the rocket. Virtually every launch is optimal and produces a maximum rocket flight for the power provided by the user, regardless of at what power level the release occurs.

Although a preferred embodiment of the invention has been disclosed for purposes of illustration, it should be understood that various changes, modifications and substitutions may be incorporated in the embodiment without departing from the spirit of the invention, which is defined by the claims which follow.

What is claimed is:

1. A toy rocket launch system, comprising:

an outer sleeve member;

an inner sleeve member which fits in a slidable airtight relationship with the outer sleeve member;

an end assembly which extends from a distal end of the inner sleeve member;

a rigid bow member having an opening through which the end assembly extends, the bow member having holding elements at opposing ends thereof;

a stretchable cord member which extends from one holding element to an end piece of the outer sleeve member and then to the other holding member, such that as the outer sleeve member is drawn rearwardly away from the inner sleeve, an internal pump chamber increases in volume between the proximal end of the inner sleeve member and the internal end of the outer sleeve member; and a launch tube at the distal end of the end assembly for support of a toy foam rocket, wherein when the rearwardly extended tensioned outer sleeve member is released a large volume of air moves through the inner sleeve member and through the launch tube, launching the toy rocket into the air.

2. The launch system of claim 1, wherein the bow member is curved.

3. The launch system of claim 1, wherein the stretchable member is a bungee cord.

4. The launch system of claim 1, wherein the stretchable member comprises springs.

5. A toy rocket launch system, comprising:

an outer sleeve member;

an inner sleeve member which fits in a slidable airtight relationship with the outer sleeve member;

an end assembly which extends from a distal end of the inner sleeve member, including a launch tube for receiving a toy rocket; and a stretchable member which extends between a forward connection near the distal end of the inner sleeve member and a rear connection near a proximal end of the outer sleeve member, wherein when the outer sleeve member is pulled back, increasing the tension on the stretchable member, and then released, a volume of air moves quickly through the inner sleeve member and out through the launch tube, launching the toy rocket into the air.

6. The launch system of claim 5, wherein the stretchable member is a bungee cord.

7. The launch system of claim 5, wherein the stretchable member is a spring.

8. The launch system of claim 5, including a finger loop at a proximal external end of the outer sleeve member.

9. The launch system of claim 5, wherein the extending end assembly includes a grip portion for the user's hand.

10. The launch system of claim 5, including a first post member assembly at the distal internal end of the inner sleeve member, a second post member assembly at the proximal internal end of the outer sleeve member and a continuous stretchable cord which extends around the first and second post members.

11. The launch system of claim 5, including a post member assembly at the distal internal end of the inner sleeve member, an attachment assembly at the proximal internal end of the outer sleeve member and a stretchable cord which extends from the attachment member to and around the post member and then back to the attachment member.

12. The launch system of claim 5, including a foam flap member which is positioned in the rear connection of the stretchable member between a bungee cord attachment member and an end piece.

* * * * *